US008156751B2

(12) United States Patent
Jayanth

(10) Patent No.: US 8,156,751 B2
(45) **Date of Patent: *Apr. 17, 2012**

(54) CONTROL AND PROTECTION SYSTEM FOR A VARIABLE CAPACITY COMPRESSOR

(75) Inventor: Nagaraj Jayanth, Sidney, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 1082 days.

This patent is subject to a terminal disclaimer.

(21) Appl. No.: 11/439,514

(22) Filed: May 23, 2006

(65) Prior Publication Data

US 2006/0280627 A1 Dec. 14, 2006

Related U.S. Application Data

(60) Provisional application No. 60/684,109, filed on May 24, 2005.

(51) Int. Cl.
*F25B 1/00* (2006.01)
*H02P 1/54* (2006.01)

(52) U.S. Cl. ..... 62/228.5; 62/228.1; 318/109

(58) Field of Classification Search ..... 62/228.5, 62/157, 228.1; 417/44.1, 45
See application file for complete search history.

(56) References Cited

U.S. PATENT DOCUMENTS

| | | | | |
|---|---|---|---|---|
| 3,606,752 | A | 9/1971 | Shaw | |
| 4,655,688 | A | 4/1987 | Bohn et al. | |
| 4,850,198 | A * | 7/1989 | Helt et al. | 62/93 |
| 4,884,412 | A | 12/1989 | Sellers et al. | |
| 4,975,024 | A | 12/1990 | Heckel | |
| 5,018,366 | A * | 5/1991 | Tanaka et al. | 62/228.5 |
| 5,070,932 | A * | 12/1991 | Vlasak | 165/240 |
| 5,355,691 | A * | 10/1994 | Sullivan et al. | 62/201 |
| 5,572,878 | A | 11/1996 | Kapoor | |
| 5,611,674 | A | 3/1997 | Bass et al. | |
| 5,613,841 | A | 3/1997 | Bass et al. | |
| 5,628,199 | A * | 5/1997 | Hoglund et al. | 62/155 |
| 5,713,724 | A | 2/1998 | Centers et al. | |
| 5,741,120 | A | 4/1998 | Bass et al. | |
| 5,797,276 | A * | 8/1998 | Howenstine et al. | 62/186 |
| 5,803,716 | A * | 9/1998 | Wallis et al. | 417/310 |

(Continued)

FOREIGN PATENT DOCUMENTS

CN 1348064 5/2002

(Continued)

OTHER PUBLICATIONS

Notification of the First Office Action regarding Application No. 200680002206.1 dated Mar. 20, 2009, summarized by CCPIT Patent and Trademark Law Office.

(Continued)

*Primary Examiner* — Chen Wen Jiang
(74) *Attorney, Agent, or Firm* — Harness, Dickey & Pierce, P.L.C.

(57) ABSTRACT

A system includes a power source, a compressor that operates in a reduced-capacity mode and a full-capacity mode, and an actuation assembly that modulates the compressor between the reduced-capacity mode and the full-capacity mode. A controller reduces the power source to a predetermined level prior to the power source being supplied to the actuation assembly for use by the actuation assembly in controlling the compressor between the reduced-capacity mode and the full-capacity mode.

26 Claims, 6 Drawing Sheets

U.S. PATENT DOCUMENTS

| | | | | |
|---|---|---|---|---|
| 6,086,335 | A | 7/2000 | Bass et al. | |
| 6,120,255 | A | 9/2000 | Schumann et al. | |
| 6,125,642 | A | 10/2000 | Seener et al. | |
| 6,139,280 | A * | 10/2000 | Holt et al. | 417/26 |
| 6,176,686 | B1 | 1/2001 | Wallis et al. | |
| 6,407,530 | B1 * | 6/2002 | Kwon et al. | 318/778 |
| 6,412,293 | B1 * | 7/2002 | Pham et al. | 62/228.3 |
| 6,471,486 | B1 | 10/2002 | Centers et al. | |
| 6,663,358 | B2 * | 12/2003 | Loprete et al. | 417/313 |
| 6,939,114 | B2 * | 9/2005 | Iwanami et al. | 417/374 |
| 7,296,426 | B2 * | 11/2007 | Butler et al. | 62/181 |
| 7,748,225 | B2 * | 7/2010 | Butler et al. | 62/181 |
| 2003/0095895 | A1 | 5/2003 | O'Loughlin | |
| 2003/0222609 | A1 * | 12/2003 | Tolbert et al. | 318/296 |
| 2004/0237551 | A1 * | 12/2004 | Schwarz et al. | 62/229 |
| 2005/0011207 | A1 | 1/2005 | Porter et al. | |

FOREIGN PATENT DOCUMENTS

| | | | |
|---|---|---|---|
| CN | 1384290 | | 12/2002 |
| CN | 1430702 | | 7/2003 |
| CN | 1506633 | A | 6/2004 |
| CN | 1510356 | | 7/2004 |
| CN | 1737440 | A | 1/2005 |
| EP | 0 085 246 | | 8/1983 |
| JP | 02-110242 | | 4/1990 |
| JP | 06066270 | A | 3/1994 |
| JP | 11281213 | A * | 10/1999 |

OTHER PUBLICATIONS

Second Office Action regarding Chinese Application No. 2006800022061 dated Nov. 13, 2009.

International Search Report for International Application No. PCT/US06/20179, dated Dec. 21, 2006.

Written Opinion of the International Searching Authority for International Application No. PCT/US06/20179, dated Jan. 26, 2007.

* cited by examiner

CONTROL AND PROTECTION SYSTEM FOR A VARIABLE CAPACITY COMPRESSOR

CROSS-REFERENCE TO RELATED APPLICATIONS

This application claims the benefit of U.S. Provisional Application No. 60/684,109, filed on May 24, 2005. The disclosure of the above application is incorporated herein by reference.

FIELD

The present teachings relate to compressors and, more particularly, to a capacity-modulated compressor.

BACKGROUND

Cooling systems such as those used in residential and commercial buildings typically include at least one compressor that circulates refrigerant between an evaporator and a condenser to provide a desired cooling effect. The compressor may be tied either directly or indirectly to a thermostat capable of controlling operation of the compressor and, thus, operation of the cooling system. The thermostat is typically disposed in an area within a residential or commercial building that is centrally located or is otherwise indicative of the temperature within the building.

The compressor associated with the cooling system may output pressurized refrigerant at more than one capacity. Such compressors allow the thermostat to choose between a full-capacity mode and a reduced-capacity mode to more closely match compressor output with the cooling requirements of the building.

An actuation device, such as a solenoid, may be used to modulate compressor capacity between the reduced-capacity mode and full-capacity mode by selectively providing leak paths between a non-orbiting scroll member and an orbiting scroll member of the compressor. The leak paths are achieved by selectively separating the scrolls—radially or axially—to reduce the ability of the scrolls to compress refrigerant.

The solenoid may be selectively supplied with power to toggle the compressor between the reduced-capacity mode and full-capacity mode and typically experiences a rise in temperature due to the supplied power. Furthermore, because the solenoid interacts with at least one of the orbiting scroll member and the non-orbiting scroll member, the solenoid may be partially disposed within a shell of the scroll compressor and additionally experience a rise in temperature due to operation of the compressor. Operation of the solenoid under increased temperature conditions either caused by power supplied to the solenoid and/or lack of refrigerant circulation within the compressor may adversely affect the performance and durability of the solenoid.

Operation of the solenoid under certain operating conditions of the compressor may damage the solenoid and/or compressor. For example, if the compressor experiences a low-side fault, such as a loss of suction pressure, or is simply off, refrigerant is not circulated through the compressor and the solenoid may overheat, if operated. Any other operating condition where the compressor fails to operate (i.e., a locked rotor condition, an electrical fault such as a faulty fan capacitor, an opening winding circuit, etc.) will similarly cause the solenoid to overheat, if operated, and may cause damage to the solenoid and/or compressor.

SUMMARY

A system includes a power source, a compressor that operates in a reduced-capacity mode and a full-capacity mode, and an actuation assembly that modulates the compressor between the reduced-capacity mode and the full-capacity mode. A controller reduces the power source to a predetermined level prior to the power source being supplied to the actuation assembly for use by the actuation assembly in controlling the compressor between the reduced-capacity mode and the full-capacity mode.

Further areas of applicability of the present teachings will become apparent from the detailed description provided hereinafter. It should be understood that the detailed description and specific examples, are intended for purposes of illustration only and are not intended to limit the scope of the teachings.

BRIEF DESCRIPTION OF THE DRAWINGS

The present teachings will become more fully understood from the detailed description and the accompanying drawings, wherein.

DETAILED DESCRIPTION

The following description is merely exemplary in nature and is in no way intended to limit the teachings, application, or uses.

With reference to the drawings, a control system 10 for a cooling system 12 is provided. The control system 10 monitors operational characteristics of the cooling system 12 and modulates a compressor 13 associated with the cooling system 12 between a reduced-capacity mode and a full-capacity mode. Modulation between the reduced-capacity mode and the full-capacity mode allows the control system 10 to tailor an output of the compressor 13 to the cooling requirements of the system 12 and, thus, increase the overall efficiency of the cooling system 12.

The compressor 13 may be a variable-capacity compressor and may include a compressor protection and control system (CPCS) 15 that works in conjunction with the control system 10. The CPCS 15 determines an operating mode for the compressor 13 based on sensed compressor parameters to protect the compressor 13 by limiting operation when conditions are unfavorable. The CPCS 15 may be of the type disclosed in Assignee's commonly owned U.S. patent application Ser. No. 11/059,646, filed on Feb. 16, 2005, the disclosure of which is incorporated herein by reference.

The compressor 13 is described and shown as a two-stage, scroll compressor but it should be understood that any type of variable-capacity compressor may be used with the control system 10. Furthermore, while the compressor 13 will be described in the context of a cooling system 12, compressor 13 may similarly be incorporated into other such systems such as, but not limited to, a refrigeration, heat pump, HVAC, or chiller system.

Figure 1:
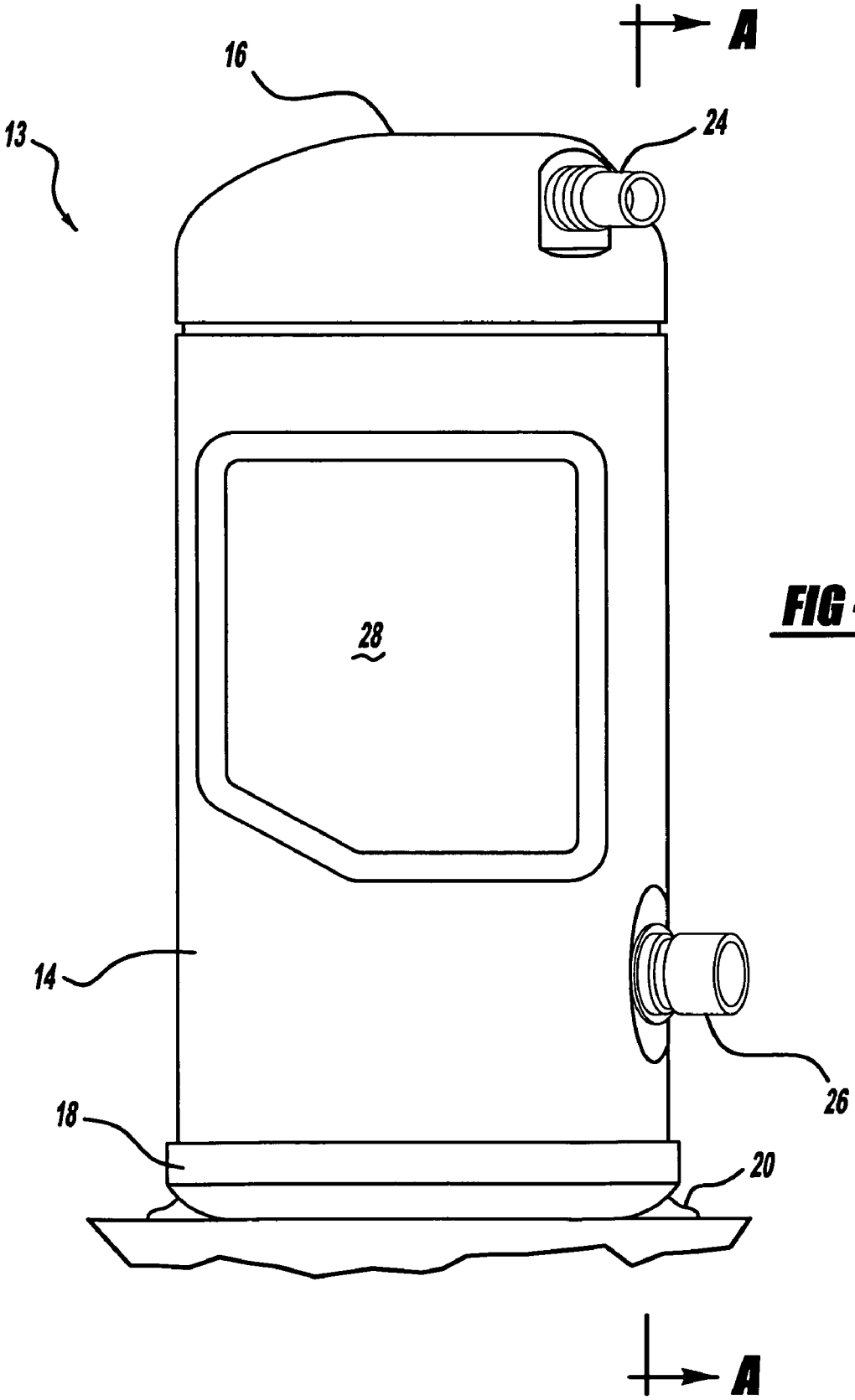
FIG. 1 is a perspective view of a compressor in accordance with the principles of the present teachings.

With particular reference to FIG. 1, the compressor 13 is shown to include a generally cylindrical hermetic shell 14 having a welded cap 16 at a top portion and a base 18 having a plurality of feet 20 welded at a bottom portion. The cap 16 and base 18 are fitted to the shell 14 to define an interior volume 22 of the compressor 13. The cap 16 is provided with a discharge fitting 24, while the shell 14 is similarly provided with an inlet fitting 26 disposed generally between the cap 16 and base 18. In addition, an electrical enclosure 28 is fixedly attached to the shell 14 generally between the cap 16 and base 18 and operably supports a portion of the CPCS 15 therein.

A crankshaft 30 is rotatively driven relative to the shell 14 by an electric motor 32. The motor 32 includes a stator 34 fixedly supported by the hermetic shell 14, windings 36 passing therethrough, and a rotor 38 press fitted on the crankshaft 30. The motor 32 and associated stator 34, windings 36, and rotor 38 drive the crankshaft 30 relative to the shell 14 to thereby compress a fluid.

The compressor 13 further includes an orbiting scroll member 40 having a spiral vane or wrap 42 on the upper surface thereof for use in receiving and compressing a fluid. An Oldham coupling 44 is positioned between orbiting scroll member 40 and a bearing housing 46 and is keyed to orbiting scroll member 40 and a non-orbiting scroll member 48. The Oldham coupling 44 transmits rotational forces from the crankshaft 30 to the orbiting scroll member 40 to thereby compress a fluid disposed between the orbiting scroll member 40 and non-orbiting scroll member 48. Oldham coupling 44 and its interaction with orbiting scroll member 40 and non-orbiting scroll member 48 may be of the type disclosed in Assignee's commonly owned U.S. Pat. No. 5,320,506, the disclosure of which is incorporated herein by reference.

Non-orbiting scroll member 48 also includes a wrap 50 positioned in meshing engagement with wrap 42 of orbiting scroll member 40. Non-orbiting scroll member 48 has a centrally disposed discharge passage 52 that communicates with an upwardly open recess 54. Recess 54 is in fluid communication with discharge fitting 24 defined by cap 16 and partition 56, such that compressed fluid exits the shell 14 via passage 52, recess 54, and fitting 24. Non-orbiting scroll member 48 is designed to be mounted to bearing housing 46 in a suitable manner such as disclosed in the aforementioned U.S. Pat. No. 4,877,382 or U.S. Pat. No. 5,102,316, the disclosures of which are incorporated herein by reference.

The enclosure 28 includes a lower housing 58, an upper housing 60, and a cavity 62. The lower housing 58 is mounted to the shell 14 using a plurality of studs 64 that are welded or otherwise fixedly attached to the shell 14. The upper housing 60 is matingly received by the lower housing 58 and defines the cavity 62 therebetween. The cavity 62 may be operable to house respective components of the control system 10 and/or CPCS 15.

Figure 2:
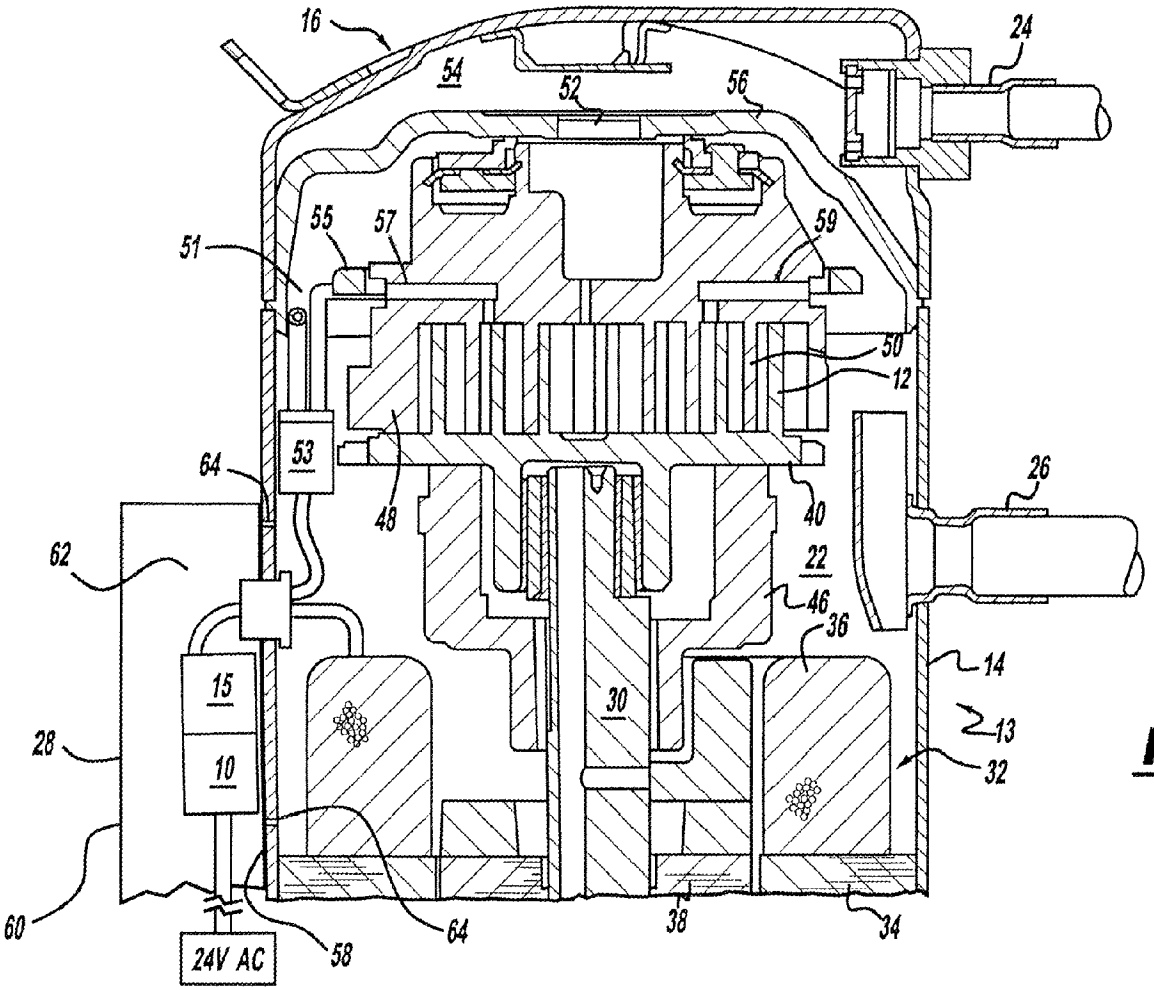
FIG. 2 is a cross-sectional view of the compressor of FIG. 1 taken along line A-A.

The compressor 13 is shown as a two-stage compressor having an actuating assembly 51 that selectively separates the orbiting scroll member 40 from the non-orbiting scroll member 48 to modulate the capacity of the compressor 13. The actuating assembly 51 may include a DC solenoid 53 connected to the orbiting scroll member 40 such that movement of the solenoid 53 between a full-capacity position and a reduced-capacity position causes concurrent movement of the orbiting scroll member 40 and, thus, modulation of compressor capacity. While the solenoid 53 is shown in FIG. 2 as disposed entirely within the shell 14 of the compressor 13, the solenoid 53 may alternatively be positioned outside of the shell 14 of the compressor 13. It should be understood that while a DC solenoid 53 is disclosed, that an AC solenoid may alternatively be used with the actuating assembly 51 and should be considered within the scope of the present teachings.

When the solenoid 53 is in the reduced-capacity position, the compressor 13 is in a reduced-capacity mode, which produces a fraction of a total available capacity. For example, when the solenoid 53 is in the reduced-capacity position, the compressor 13 may only produce approximately two-thirds of the total available capacity. Other reduced capacities are available, as such as at or below about ten percent to about ninety percent or more. When the solenoid 53 is in the full-capacity position, however, the compressor 13 is in a full-capacity mode and provides a maximum cooling capacity for the cooling system 12 (i.e., about one-hundred percent capacity or more).

Movement of the solenoid 53 into the reduced-capacity position allows a valving ring 55 to move into a position in which passages 57, 59 are no longer closed off, thereby allowing fluid to be exhausted or vented from moving fluid pockets defined by the intermeshing scroll members 40 and 48 to reduce an output of the compressor 13. Conversely, movement of the solenoid 53 into the full-capacity position allows movement of the valving ring 55 into a sealing overlying relationship with the passages 57, 59, thereby preventing fluid disposed within the moving fluid pockets defined by the intermeshing scroll members 40 and 48 from being exhausted or vented through passages 57, 59 to increase an output of the compressor 13. In this manner, the capacity of the compressor 13 may be modulated in accordance with cooling demand or in response to a fault condition. The actuation assembly 51 is preferably of the type disclosed in Assignee's commonly owned U.S. Pat. No. 6,412,293, the disclosure of which is incorporated herein by reference.

Figure 3:
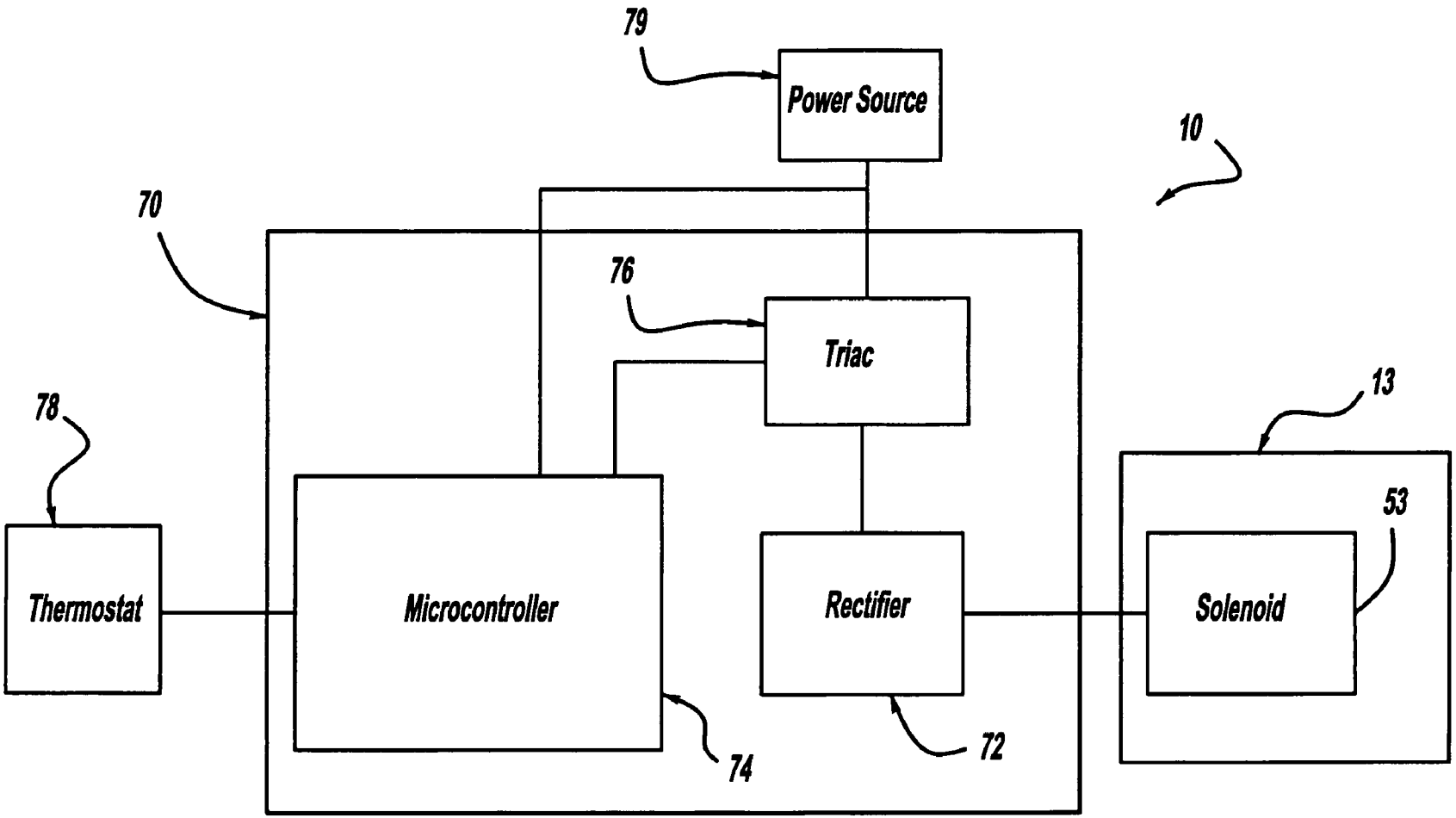
FIG. 3 is a block diagram of a control system for use with the compressor of FIG. 1.

With reference to FIGS. 2 and 3, the control system 10 includes a controller 70 having a rectifier 72, a microcontroller 74, and a triac 76 mounted to the shell 14 of the compressor 13 within the enclosure 28. While the controller 70 is described and shown as being mounted to the shell 14 of the compressor 13, the controller 70 may alternatively be remotely located from the compressor 13 for controlling operation of the solenoid 53.

The rectifier 72, microcontroller 74, and triac 76 cooperate to control movement of the solenoid 53 and, thus, the capacity of the compressor 13. The system 10 is supplied by an AC power source 79, such as 24-volt AC, connected to the triac 76. The triac 76 receives the AC voltage and reduces the voltage prior to supplying the rectifier 72. While the triac 76 is described as being connected to a 24-volt AC power source, the triac 76 may be connected to any suitable AC power source.

The microcontroller 74 is connected to the AC power source 79 to monitor the input voltage to the triac 76 and is also connected to the triac 76 for controlling the power supplied to the solenoid 53. The microcontroller 74 is additionally coupled to a thermostat 78 and controls operation of the triac 76 based on input received from the thermostat 78. While the controller 70 is described as including a microcontroller 74, the controller 70 may share a processor such as a microcontroller with the CPCS 15. Furthermore, while a microcontroller 74 is disclosed, any suitable processor may alternatively be used by both the CPCS 15 and the controller 70.

The microcontroller 74 may either be a stand-alone processor for use solely by the control system 10 or, alternatively, may be a common processor, shared by both the control system 10 and the CPCS 15. In either version, the microcontroller 74 is in communication with the CPCS 15. Communication between the microcontroller 74 and the CPCS 15 allows the microcontroller 74 to protect the solenoid 53 from damage during periods when the CPCS 15 determines a compressor and/or system fault condition.

For example, if the CPCS 15 detects a low-side fault, such as a loss of suction pressure, the microcontroller 74 may react to the particular fault detected and restrict power to the solenoid 53. Continued operation of the solenoid 53 under a low-side fault, such as a loss of suction pressure, may cause the solenoid 53 to heat up excessively as refrigerant is not cycled through the compressor 13 and therefore does not cool the solenoid 53 during operation. Such action prevents operation of the solenoid 53 when conditions within the compressor 13 and/or system 12 are unfavorable.

The triac 76 is coupled to both the rectifier 72 and the microcontroller 74. The triac 76 receives AC voltage from the AC power source 79 and selectively supplies reduced AC voltage to the rectifier 72 based on control signals from the microcontroller 74.

In operation, the rectifier 72 receives the reduced AC voltage from the triac 76 and converts the AC voltage to DC voltage prior to supplying the solenoid 53. The reduced AC voltage supplied by the triac 76 results in reduced DC voltage being supplied to the solenoid 53 (via rectifier 72) and therefore reduces the operating temperature of the solenoid 53. As a result, the solenoid 53 is protected from damage related to overheating. While a triac 76 is disclosed, any suitable device for reducing the AC voltage from the power source 79, such as, but not limited to, a MOSFET, is anticipated and should be considered within the scope of the present teachings.

Figure 5:
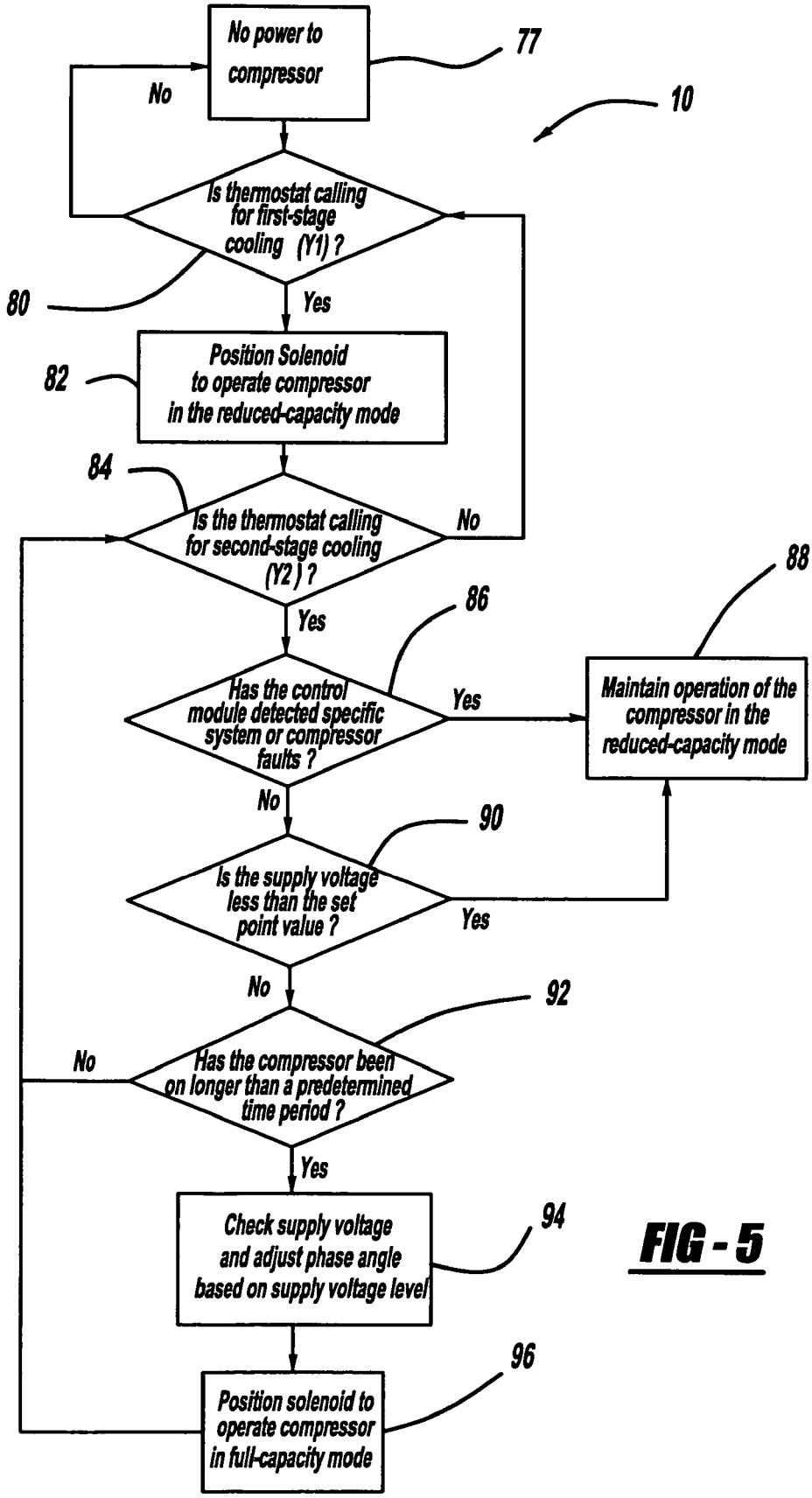
FIG. 5 is a flow chart of the control system of FIG. 3.
Figure 6:
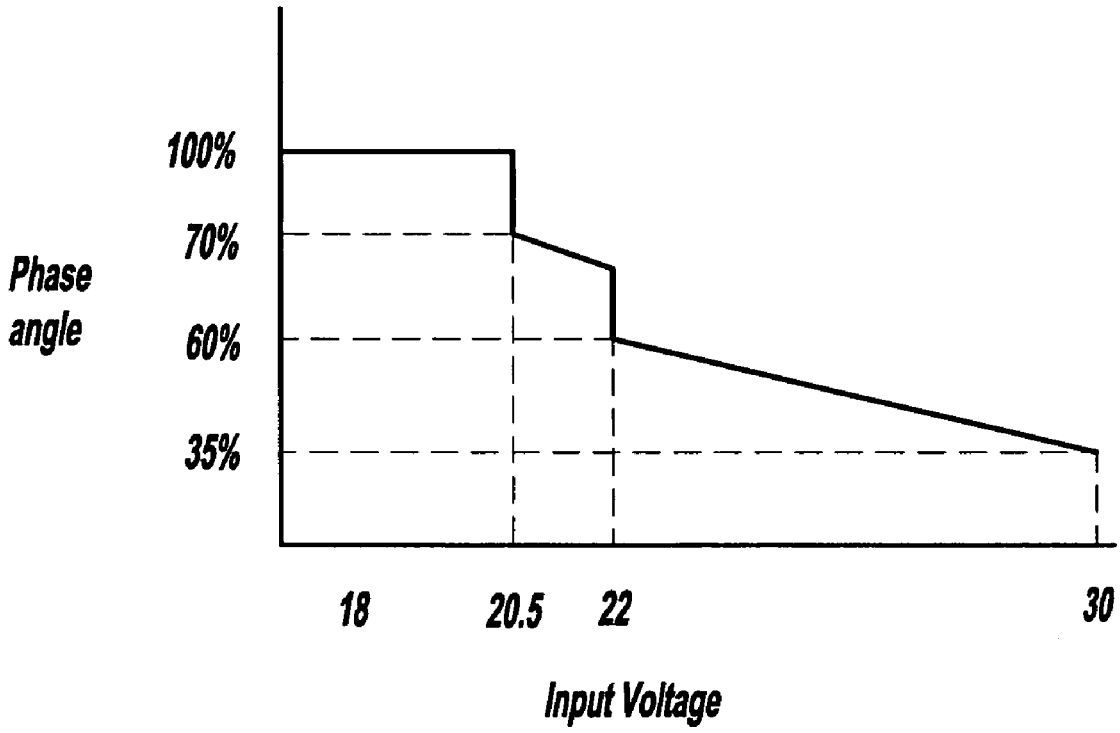
FIG. 6 is a graph showing phase angle versus input voltage for use with the flow chart of FIG. 5.

With reference to FIGS. 5 and 6, operation of the control system 10 and cooling system 12 will be described in detail. The solenoid 53 is initially biased into the reduced-capacity position such that the compressor 13 is in the reduced-capacity mode. Positioning the solenoid 53 in such a manner allows the compressor 13 to commence operation in the reduced-capacity mode (i.e., under part load). Initially operating the compressor 13 in the reduced-capacity mode prevents excessive and unnecessary wear on internal components of the compressor 13 and therefore extends the operational life of the compressor 13. Starting the compressor in the reduced-capacity load also obviates the need for a start capacitor or a start kit (i.e., a capacitor and relay combination, for example) and therefore reduces the cost and complexity of the system.

Figure 4:
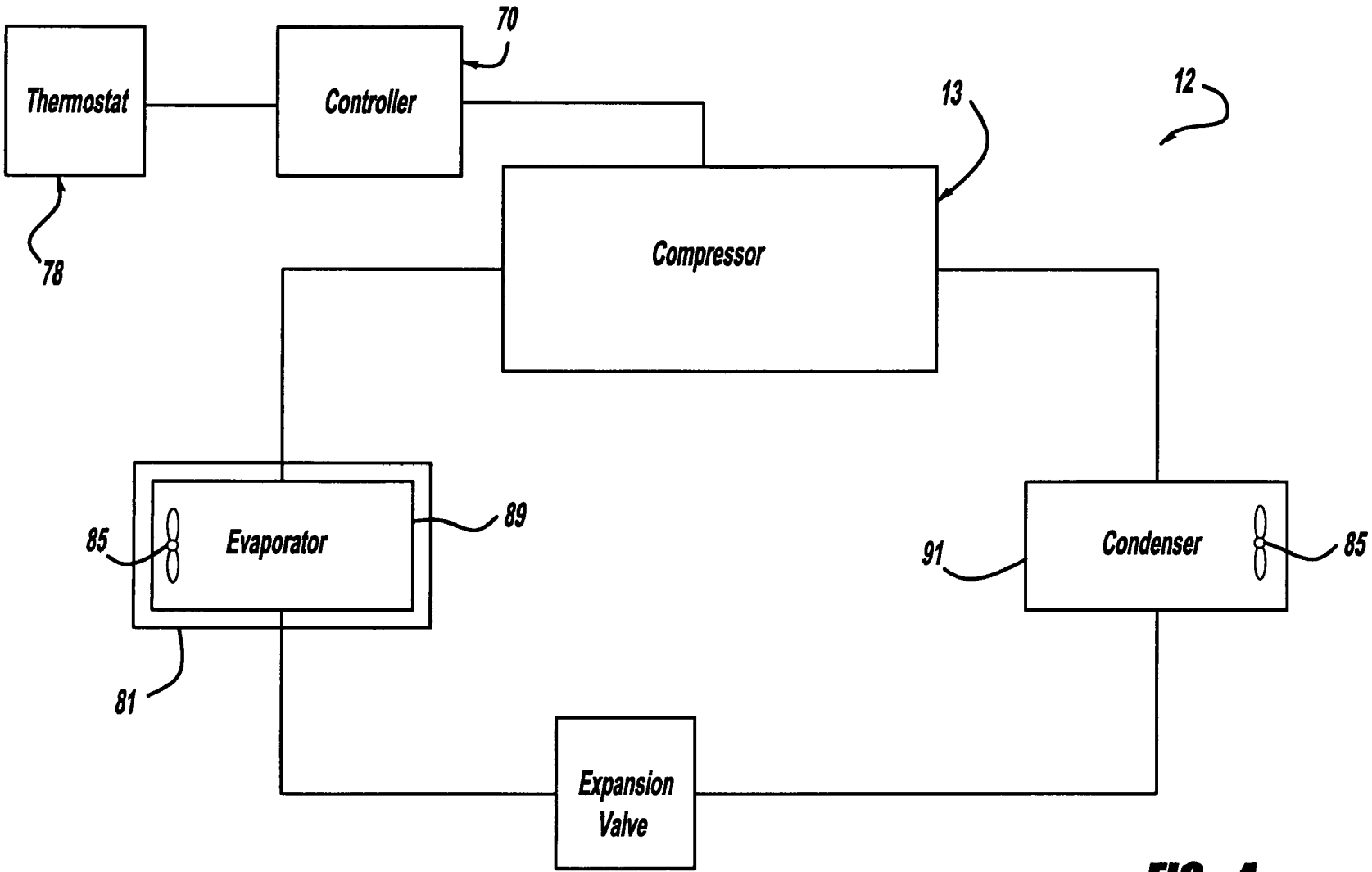
FIG. 4 is an environmental view of a cooling system having the compressor of FIG. 1 and the control system of FIG. 3 incorporated therein.

In operation, the thermostat 78 monitors a temperature of a refrigerated space 81, such as an interior of a building or refrigerator to compare the detected temperature to a set point temperature (FIG. 4). The set point temperature is generally input at the thermostat 78 to allow an occupant to adjust the temperature inside the building to a desired setting. When the thermostat 78 determines that the detected temperature in the refrigerated space 81 exceeds the set point temperature, the thermostat 78 first determines the degree by which the detected temperature exceeds the set point temperature.

If the detected temperature exceeds the set point temperature by a minimal amount (e.g., between one and three degrees Fahrenheit), the thermostat 78 calls for first-stage cooling by generating a first control signal (designated by Y1 in FIG. 5). If the detected temperature exceeds the set point temperature by a more significant amount (e.g., greater than five degrees Fahrenheit), the thermostat 78 calls for second-stage cooling by generating a second control signal (designated by Y2 in FIG. 5). The respective signals Y1, Y2 are sent to the microcontroller 74 of the control system 10 for modulating compressor capacity between the reduced-capacity mode and the full-capacity mode through modulation of the solenoid 53.

The above operation is based on use of a two-stage thermostat capable of producing multiple control signals based on operating temperatures within a building. Because two-stage thermostats are relatively expensive, control of the compressor 13 between the reduced-capacity mode and the full-capacity mode may be achieved by monitoring a length of time the compressor 13 is operating in the reduced-capacity mode. For example, if the compressor 13 is operating in the reduced-capacity mode for a predetermined amount of time, and the thermostat 78 is still calling for increased cooling, the microcontroller 74 can toggle the compressor 13 into the full-capacity mode. By allowing the microcontroller 74 to regulate operation of the compressor 13 between the reduced-capacity mode and full-capacity mode based on cooling demand indicated by the thermostat 78 and the time interval in which the compressor 13 is operating in the reduced-capacity mode, use of a two-stage thermostat is obviated. For simplicity, operation of the compressor 13 and related CPCS 15 will be described in conjunction with a two-stage thermostat 78.

At the outset, the compressor 13 is initially at rest such that power is restricted from the motor 32 at operation 77. The microcontroller 74 monitors the thermostat 78 for signal Y1, which is indicative of a demand for first-stage cooling at operation 80. If the thermostat is not calling for first-stage cooling, the compressor 13 remains at rest. If the thermostat 78 calls for first-stage cooling, the microcontroller 74 energizes the compressor 13 in the reduced-capacity mode (i.e., part load) to circulate refrigerant through the cooling system 12 at operation 82. At this point, the solenoid 53 is in the reduced-capacity position.

Starting the compressor 13 under part load (i.e., in the reduced-capacity mode) reduces the initial load experienced by the compressor 13. The reduction in load increases the life of the compressor 13 and promotes starting of the compressor 13. If the compressor 13 is started in the full-capacity mode (i.e., when the solenoid 53 is in the full-capacity position), the compressor 13 may experience difficulty due to the heavier load Once operating in the reduced-capacity mode, the microcontroller 74 monitors the thermostat 78 for signal Y2, which is indicative of a demand for second-stage cooling at operation 84. If the thermostat 78 is not calling for second-stage cooling, the microcontroller 74 continues to monitor the thermostat 78 for a Y2 signal and continues operation of the compressor 13 in the reduced-capacity mode until the thermostat 78 ceases to call for fist-stage cooling. If the thermostat 78 calls for second-stage cooling, the microcontroller 74 determines if the CPCS 15 has detected any specific system or compressor faults at operation 86. If the CPCS 15 has detected a specific compressor or system fault, the microcontroller 74 maintains operation of the compressor 13 in the reduced-capacity mode at operation 88, regardless of the demand for second-stage cooling to protect the compressor 13 and solenoid 53 from full-capacity operation under unfavorable conditions.

Compressor faults such as a locked rotor condition, electrical faults such as a faulty fan capacitor or an opening winding circuit, and/or a system fault such as a loss of charge or a dirty condenser, may cause damage to the compressor 13 and/or solenoid 53 if the compressor 13 is operating in the full-capacity mode. Therefore, the microcontroller 74 maintains operation of the compressor 13 in the reduced-capacity mode to protect the compressor 13 and the solenoid 53 when the CPCS 15 detects such a compressor, electrical, and/or system fault.

If the CPCS 15 has not detected a compressor or system fault, the microcontroller 74 then checks the pilot voltage level (i.e., voltage source 79) supplied to the triac 76 at operation 90. For an exemplary 24-volt AC power source, if the input voltage is less than approximately 18 volts, the microcontroller 74 maintains the solenoid 53 in the reduced-capacity position, and thus, the compressor 13 in the reduced-capacity mode, regardless of the demand for second-stage cooling at operation 88. However, if the input voltage is greater than approximately 18 volts, the microcontroller 74 determines if the compressor 13 has been running for a predetermined time period at operation 92.

If the compressor 13 has been operating for a time period that is less than about five seconds, the microcontroller 74 continues operation of the compressor 13 in the reduced-capacity mode by maintaining the position of the solenoid 53 in the reduced-capacity position. While a time period of about five seconds is disclosed, any suitable time period may be used.

If the microcontroller 74 determines that the compressor 13 has been operating longer than approximately five seconds, the microcontroller 74 once again checks the pilot voltage supplied to the triac 76 and adjusts the phase angle of the supplied AC voltage at operation 94. The detected voltage is referenced on a phase-control angle graph (FIG. 6) to determine a suitable phase-angle for use by the triac 76 in supplying DC voltage to the solenoid 53.

For example, if the detected voltage is 22 volts, the microcontroller 74 adjusts the phase angle to sixty percent. Furthermore, if the detected voltage is 20.5 volts, the microcontroller 74 adjusts the phase angle to seventy percent. Such adjustments allow the microcontroller 74 to continually supply a proper amount of voltage to the solenoid 53 during periods of voltage fluctuation.

Once the phase angle is determined, the microcontroller 74 positions the solenoid 53 to operate the compressor 13 in the full-capacity mode at operation 96. The microcontroller 74 supplies DC voltage to the solenoid 53 via the triac 76 for approximately 0.9 seconds. Energizing the solenoid 53 moves the solenoid 53 from the reduced-capacity position to the full-capacity position and changes compressor capacity from the reduced-capacity mode to the full-capacity mode. The microcontroller 74 continues operation of the compressor 13 in the full-capacity mode until the thermostat 78 removes the Y2 signal. While the solenoid 53 is energized for about 0.9 seconds, the solenoid 53 may be energized for a shorter or longer time depending on the particular solenoid 53 and compressor 13.

When the compressor 13 operates in the full-capacity mode, blowers (schematically represented by reference number 85 in FIG. 4) respectively associated with an evaporator 89 and condenser 91 should increase rotational speed to increase airflow through the respective heat exchanger. The increased rotational speed may be accomplished by using the same five-second time delay used in actuating the compressor 13 from the reduced-capacity mode to the full-capacity mode such that the increased rotational speed coincides with the transition from first-stage cooling to second-stage cooling.

For example, if the blowers 85 are operating for approximately five seconds, each of the blowers 85 may automatically increase rotational speed to a full-speed state. The increased rotational speed of the blowers 85 is therefore automatically configured to occur at approximately the same time the compressor 13 is modulated into the full-capacity mode and is not a result of a command from the thermostat 78. This configuration reduces the complexity of the control system 10 while still providing a gain in efficiency and operation.

The control system 10 allows for modulation of a compressor between a reduced-capacity mode and a full-capacity mode by selectively supplying DC voltage to the solenoid 53. The supplied voltage is supplied via a triac 76 and rectifier 72 to reduce the voltage applied to the solenoid 53. The reduction in voltage allows the solenoid 53 operate at a lower temperature and, thus, protects the solenoid 53 from overheating. Furthermore, the reduced voltage also provides for use of a smaller transformer (such as in a furnace) with which the cooling system 12 may be associated as less voltage is required to actuate the solenoid 53 between the reduced-capacity position and the full-capacity position.

The control system additionally provides for use of a single-stage thermostat or a two-stage thermostat. As noted above, either thermostat will work with the compressor 13 and CPCS 15, but choosing the single-stage thermostat rather than a two-stage thermostat reduces the overall cost and complexity of the system. The single-stage thermostat 78 provides two-stage functionality by controlling modulation of the compressor 13 from the reduced-capacity mode to the full-capacity mode by timing how long the compressor 13 operates in the reduced-capacity mode rather than supplying two different cooling signals (i.e., one for reduced-capacity and one for full-capacity). Furthermore, the timing principles may also be applied to operation of evaporator and condenser blowers 85 by coordinating an increase in rotational speed with the increase in compressor capacity. Therefore, the control system 10 reduces both the complexity and cost of the control system 10 and cooling system 12.

The description of the teachings is merely exemplary in nature and, thus, variations are not to be regarded as a departure from the spirit and scope of the teachings.

What is claimed is:

1. A system comprising a controller operable to reduce power from a power source to a reduced-power level supplied to a solenoid operable between a first position modulating a compressor in a reduced-capacity mode and a second position modulating said compressor in a full-capacity mode, said controller monitoring a voltage supplied by said power source and adjusting the phase-angle of said voltage by referencing said voltage on a relationship of phase-angle and voltage.

2. The system of claim 1, further comprising a DC power source as the power source.

3. The system of claim 1, further comprising an AC power source as the power source.

4. The system of claim 3, wherein said controller includes a rectifier operable to convert the power source from said AC power source to a DC power source.

5. The system of claim 1, further comprising a triac, said controller controlling said triac to reduce said power source to said reduced-power level.

6. The system of claim 1, further comprising a thermostat in communication with said controller.

7. The system of claim 6, wherein said thermostat is a single-stage thermostat operable to supply said controller with a signal indicative of a demand for cooling.

8. The system of claim 7, wherein said controller is operable to control said compressor based on a run time of said compressor in said reduced-capacity mode and said signal from said thermostat.

9. The system of claim 6, wherein said thermostat is a dual-stage thermostat operable to supply said controller with a signal indicative of a demand for cooling.

10. The system of claim 9, wherein said signal includes a first signal and a second signal, said dual-stage thermostat is operable to supply said first signal to said controller to indicate demand for said reduced-capacity mode and operable to supply said second signal to said controller to indicate demand for a said full-capacity mode.

11. The system of claim 1, wherein said controller is operable to control said compressor based on a run time of said compressor in said reduced-capacity mode.

12. The system of claim 1, wherein said compressor operates in said reduced-capacity mode at start up.

13. The system of claim 1, wherein said relationship is a graph of phase-angle versus voltage.

14. The system of claim 1, wherein said voltage is supplied to a triac after the phase-angle of said voltage is adjusted and prior to being supplied to said solenoid.

15. The system of claim 14, wherein said controller controls said triac based on information received from a thermostat.

16. A system comprising a controller operable to reduce power from a power source to a reduced-power level supplied to an actuation assembly operable between a first position modulating a compressor in a reduced-capacity mode and a second position modulating said compressor in a full-capacity mode, said controller selectively controlling said actuation assembly to maintain operation of said compressor in said reduced-capacity mode if said compressor experiences a predetermined fault condition.

17. The system of claim 16, wherein said predetermined fault condition includes at least one of a locked rotor condition, a loss of suction pressure, a loss of power to the compressor, a faulty fan capacitor, an opening winding circuit, a loss of charge, and a dirty condenser.

18. The system of claim 16, wherein said controller is operable to control said compressor based on a run time of said compressor in said reduced-capacity mode.

19. The system of claim 16, wherein said actuation assembly includes a solenoid operable to modulate said compressor between said reduced-capacity mode and said full-capacity mode.

20. The system of claim 16, wherein said controller reduces said power based on at least one of a supplied voltage and a phase control angle graph.

21. The system of claim 16, further comprising a triac, said controller controlling said triac to reduce said power source to said reduced-power level.

22. The system of claim 16, further comprising a DC power source as the power source.

23. The system of claim 16, further comprising an AC power source as the power source.

24. The system of claim 23, wherein said controller includes a rectifier operable to convert said power source from said AC power source to a DC power source.

25. The system of claim 24, wherein said compressor is modulated into one of said reduced-capacity mode and said full-capacity mode a predetermined time following start up.

26. The system of claim 16, wherein said compressor operates in said reduced-capacity mode at start up.

* * * * *